US009257227B2

(12) United States Patent
Haga et al.

(10) Patent No.: US 9,257,227 B2
(45) Date of Patent: Feb. 9, 2016

(54) METHOD FOR MANUFACTURING RARE-EARTH MAGNET

(71) Applicants: Kazuaki Haga, Toyota (JP); Noritaka Miyamoto, Toyota (JP); Tetsuya Shoji, Toyota (JP); Noritsugu Sakuma, Susono (JP); Shinya Omura, Nagakute (JP); Motoki Hiraoka, Toyota (JP)

(72) Inventors: Kazuaki Haga, Toyota (JP); Noritaka Miyamoto, Toyota (JP); Tetsuya Shoji, Toyota (JP); Noritsugu Sakuma, Susono (JP); Shinya Omura, Nagakute (JP); Motoki Hiraoka, Toyota (JP)

(73) Assignee: TOYOTA JIDOSHA KABUSHIKI KAISHA, Aichi (JP)

( * ) Notice: Subject to any disclaimer, the term of this patent is extended or adjusted under 35 U.S.C. 154(b) by 477 days.

(21) Appl. No.: 13/750,576

(22) Filed: Jan. 25, 2013

(65) Prior Publication Data

US 2013/0195710 A1 Aug. 1, 2013

(30) Foreign Application Priority Data

Jan. 26, 2012 (JP) ..... 2012-014275
Oct. 12, 2012 (JP) ..... 2012-226801

(51) Int. Cl.
*H01F 41/00* (2006.01)
*H01F 41/02* (2006.01)

(52) U.S. Cl.
CPC ..... *H01F 41/005* (2013.01); *H01F 41/0293* (2013.01)

(58) Field of Classification Search
CPC ..... H01F 41/0293
See application file for complete search history.

(56) References Cited

U.S. PATENT DOCUMENTS

| | | | | |
|---|---|---|---|---|
| 4,792,367 | A | 12/1988 | Lee | |
| 5,641,363 | A * | 6/1997 | Fukuno et al. | 148/104 |
| 6,319,335 | B1 | 11/2001 | Hirota et al. | |
| 8,846,136 | B2 | 9/2014 | Shoji et al. | |
| 2005/0268989 | A1 | 12/2005 | Tomizawa et al. | |
| 2005/0284545 | A1 * | 12/2005 | Komuro et al. | 148/302 |
| 2006/0022175 | A1 | 2/2006 | Komuro et al. | |
| 2006/0278517 | A1 | 12/2006 | Machida et al. | |

(Continued)

FOREIGN PATENT DOCUMENTS

| | | | |
|---|---|---|---|
| CN | 1358595 | A | 7/2002 |
| CN | 101521068 | A | 9/2009 |

(Continued)

OTHER PUBLICATIONS

Translation of JP 2005-209932.

(Continued)

*Primary Examiner* — Jessee Roe
*Assistant Examiner* — Christopher Kessler
(74) *Attorney, Agent, or Firm* — Sughrue Mion, PLLC

(57) ABSTRACT

Provided is a manufacturing method of a rare-earth magnet with high coercive force, including a first step of pressing-forming powder as a rare-earth magnet material to form a compact S, the powder including a RE-Fe—B main phase MP (RE: at least one type of Nd and Pr) and a RE-X alloy (X: metal element) grain boundary phase surrounding the main phase; and second step of bringing a modifier alloy M into contact with the compact S or a rare-earth magnet precursor C obtained by hot deformation processing of the compact S, followed by heat treatment to penetrant diffuse melt of the modifier alloy M into the compact S or the rare-earth magnet precursor C to manufacture the rare-earth magnet RM, the modifier alloy including a RE-Y (Y: metal element and not including a heavy rare-earth element) alloy having a eutectic or a RE-rich hyper-eutectic composition.

1 Claim, 13 Drawing Sheets

(56) References Cited

U.S. PATENT DOCUMENTS

| | | | |
|---|---|---|---|
| 2007/0240789 | A1 | 10/2007 | Nakamura et al. |
| 2008/0054738 | A1 | 3/2008 | Komuro et al. |
| 2008/0223489 | A1 | 9/2008 | Nagata et al. |
| 2008/0241368 | A1 | 10/2008 | Komuro et al. |
| 2008/0241513 | A1 | 10/2008 | Komuro et al. |
| 2009/0020193 | A1 | 1/2009 | Ohta et al. |
| 2010/0003156 | A1 | 1/2010 | Suzuki et al. |
| 2011/0000586 | A1 | 1/2011 | Nomura et al. |
| 2011/0090032 | A1 | 4/2011 | Nagata et al. |
| 2012/0299675 | A1 | 11/2012 | Honkura et al. |
| 2012/0312422 | A1 | 12/2012 | Yano et al. |
| 2013/0009736 | A1 | 1/2013 | Honkura et al. |
| 2013/0078369 | A1 | 3/2013 | Shoji et al. |
| 2013/0195710 | A1 | 8/2013 | Haga et al. |
| 2015/0235747 | A1 | 8/2015 | Miyamoto et al. |

FOREIGN PATENT DOCUMENTS

| | | | |
|---|---|---|---|
| CN | 101640087 | A | 2/2010 |
| JP | 02047815 | A | 2/1990 |
| JP | 2-208902 | A | 8/1990 |
| JP | 07283016 | A1 | 10/1995 |
| JP | 8-250356 | A | 9/1996 |
| JP | 8-316014 | A | 11/1996 |
| JP | 9-275004 | A | 10/1997 |
| JP | 2693601 | B2 | 12/1997 |
| JP | 2008-60183 | A | 3/2008 |
| JP | 2008-235343 | A | 10/2008 |
| JP | 2008-263179 | A | 10/2008 |
| JP | 2008-266767 | A | 11/2008 |
| JP | 2008-270699 | A | 11/2008 |
| JP | 2010-98115 | A | 4/2010 |
| JP | 2010-114200 | A | 5/2010 |
| JP | 4482769 | B2 | 6/2010 |
| JP | 2010-263172 | A | 11/2010 |
| JP | 2011-014668 | A | 1/2011 |
| JP | 2011-035001 | A | 2/2011 |
| JP | 2011-061038 | A | 3/2011 |
| JP | 4656323 | B2 | 3/2011 |
| JP | 2011-159733 | A | 8/2011 |
| JP | 4748163 | B2 | 8/2011 |
| JP | 2012-234985 | A | 11/2012 |
| JP | 5196080 | B2 | 5/2013 |
| JP | 2013-175705 | A | 9/2013 |
| WO | 2004081954 | A1 | 9/2004 |
| WO | 2011-070847 | A1 | 6/2011 |
| WO | 2011070827 | A1 | 6/2011 |
| WO | 2012/008623 | A1 | 1/2012 |
| WO | 2012/036294 | A1 | 3/2012 |

OTHER PUBLICATIONS

Communication dated Mar. 18, 2015 from the United States Patent and Trademark Office in counterpart U.S. Appl. No. 14/355,389.

Communication dated Jul. 16, 2013, issued by the U.S. Patent and Trademark Office in U.S. Appl. No. 13/700,601.

Communication dated Jan. 16, 2014, issued by the U.S. Patent and Trademark Office in U.S. Appl. No. 13/700,601.

Li et al., "The role of Cu addition in the coercivity enhancement of sintered Nd—Fe—B permanent magnets", J. Mater. Res., Feb. 2009, vol. 24, No. 2, pp. 413-419.

Mo et al., "Dependence of the crystal structure of the Nd-rich phase on oxygen content in an Nd—Fe—B sintered magnet", Scripta Materialia, Mar. 2008, vol. 59, pp. 179-182.

Fukagawa et al., "Nd/NdFeB Artificial Interface Microstructure and the Intrinsic Coercivity of Surface Nd2Fe14B Grains", NEOMAX Company, Hitachi Metals Ltd., Mar. 2008, vol. 24, pp. 40-45.

Makita et al., "Boundary Structure and the Local Crystalline Electric Field of Nd—Fe—B Sintered Magnets", Journal of Magnetics Society of Japan, Oct. 2002, vol. 26, No. 10, pp. 1060-1067.

Mishima et al., "Development of a Dy-Free NdFeB Anisotropic Bonded Magnet with a High Thermal Stability", REPM 10—Proceedings of the 21st Workshop on Rare-Earth Permanent Magnets and their Applications, 2010, pp. 253-256.

Komuro et al., "Structure and magnetic properties of NdFeB powder surrounded with layer of rare-earth fluorides", Journal of Applied Physics, 2008, vol. 103, 07E142, 3 pages total.

Liu et al., "Increased coercivity in sintered Nd—Fe—B magnets with NdF3 additions and the related grain boundary phase", Scripta Materialia, Aug. 2009, vol. 61, pp. 1048-1051.

Fukagawa et al., "The effect of oxygen on the surface coercivity of Nd-coated Nd—Fe—B sintered magnets", Journal of Applied Physics, 2009, vol. 105, 07A724, 3 pages total.

Hirosawa et al., "Recent Efforts Toward Rare-Metal-Free Permanent Magnets in Japan", REPM 10—Proceedings of the 21st Workshop on Rare-Earth Permanent magnets and their Applications, 2010, pp. 187-192.

International Search Report for PCT/JP2013/080691 dated Dec. 17, 2013.

Final Office Action dated Nov. 12, 2015, issued by the U.S. Patent and Trademark Office in U.S. Appl. No. 14/355,389.

* cited by examiner

METHOD FOR MANUFACTURING RARE-EARTH MAGNET

BACKGROUND OF THE INVENTION

1. Field of the Invention

The present invention relates to a method for manufacturing a rare-earth magnet.

2. Background Art

Rare-earth magnets containing rare-earth elements such as lanthanoide are called permanent magnets, and are used for motors making up a hard disk and a MRI as well as for driving motors for hybrid vehicles, electric vehicles and the like.

Indexes for magnet performance of such rare-earth magnets include remanence (residual flux density) and a coercive force. Meanwhile, as the amount of heat generated at a motor increases because of the trend to more compact motors and higher current density, rare-earth magnets included in the motors also are required to have improved heat resistance, and one of important research challenges in the relating technical field is how to keep a coercive force of a magnet at high temperatures. For example, in the case of a Nd—Fe—B magnet as one of rare-earth magnets that is used often for vehicle driving motors, attempts are made to increase the coercive force of the magnet by developing finer crystal grains, using an alloy having a composition containing Nd more or adding heavy rare-earth elements such as Dy and Tb having a good coercivity performance, for example.

Among heavy rare-earth elements to improve the coercivity performance, Dy is used often for this purpose. However, the amount of deposits of Dy is limited, and Dy is an expensive material. Therefore it is one of important challenges in our country at the nation level to develop a Dy-less magnet to keep the coercivity performance while reducing the amount of Dy or a Dy-free magnet to ensure the coercivity performance without containing Dy at all.

The following briefly describes one example of the method for manufacturing a rare-earth magnet. For instance, Nd—Fe—B molten metal is solidified rapidly to be fine powder, while pressing-forming the fine powder to be a compact. Hot deformation processing is performed to this compact to give magnetic anisotropy thereto to prepare a rare-earth magnet precursor (orientational magnet), into which a modifier alloy is penetrant-diffused to improve the coercive force, thus manufacturing a rare-earth magnet.

Note that JP Patent Publication (Kokai) No. 2011-035001A (Patent Document 1) and JP Patent Publication (Kokai) No. 2010-114200 A (Patent Document 2) disclose a method for manufacturing a rare-earth magnet including a nano-crystalline magnet by adding high-coercivity heavy rare-earth elements by various methods.

The manufacturing method disclosed in Patent Document 1 is to evaporate an evaporation material containing at least one of Dy and Tb so as to be grain-boundary diffused into a hot-deformed compound from a surface thereof.

This manufacturing method requires high-temperature processing at about 850 to 1,050° C. during the evaporation of the evaporation material, and such a temperature range is specified to improve remanence and suppress quick growth of crystal grains.

The heat treatment in the range of as high as 850 to 1,050° C., however, causes grain coarsening, resulting in increase of risk for deterioration in coercive force. That is, even when Dy or Tb is grain-boundary diffused, the resultant may not show a sufficient high coercive force.

Patent Document 2 discloses a manufacturing method that brings at least one type of element of Dy, Tb and Ho or an alloy of the element and at least one type of element of Cu, Al, Ga, Ge, Sn, In, Si, P and Co into contact with the surface of a rare-earth magnet, and performs heat treatment for grain-boundary diffusion so that the grain size does not exceed 1

Patent Document 2 mentions that the temperature range of 500 to 800° C. for heat treatment leads to excellent balance between a diffusion effect of Dy or the like into crystal grain boundary phase and a coarsening suppression effect of crystal grains by the heat treatment, whereby a high coercivity rare-earth magnet can be easily manufactured. Patent Document 2 discloses various embodiments using a Dy—Cu alloy and performing heat treatment at 500 to 900° C. Among these embodiments, a typical 85Dy-15Cu alloy has the melting point of 1,100° C. Accordingly, in order to penetrant-diffuse the molten metal thereof, high-temperature treatment is required at 1,000° C. or higher, and as a result grain coarsening cannot be suppressed.

In view of these circumstances (rise in the price of Dy or the like, grain coarsening under a high-temperature atmosphere to diffuse a modifier alloy containing high-melting heavy rare-earth elements into grain boundary phase or the like), the present inventors have come up with the idea for a method using a modifier alloy (modifier phase) not including heavy rare-earth metals such as Dy and Tb and penetrant-diffusing melt of the modifier alloy under a relatively low-temperature condition, thus manufacturing a high coercivity rare-earth magnet, especially having a high coercive force under a high-temperature atmosphere.

SUMMARY OF THE INVENTION

In view of the aforementioned problems, it is an object of the invention to provide a manufacturing method of a rare-earth magnet capable of penetrant-diffusing a modifier alloy to increase a coercive force (especially a coercive force under a high-temperature atmosphere) at a temperature lower than the conventional method for manufacturing a rare-earth magnet without using heavy rare-earth metals such as Dy and Tb, and accordingly capable of manufacturing a high coercivity rare-earth magnet at the lowest cost possible.

In order to fulfill this object, a method for manufacturing a rare-earth magnet of the present invention includes the steps of: first step of pressing-forming powder as a rare-earth magnet material to form a compact, the powder including a RE-Fe—B main phase (RE: at least one type of Nd and Pr) and a RE-X (X: metal element) alloy grain boundary phase surrounding the main phase; and second step of bringing a modifier alloy into contact with the compact, followed by heat treatment to penetrant-diffuse melt of the modifier alloy into the compact to manufacture the rare-earth magnet, the modifier alloy including a RL-M alloy having a eutectic or a RL-rich hyper-eutectic composition (RL: one type or two types or more of light rare-earth elements, M: one type or two types or more of transition elements or typical metal elements and not including heavy rare-earth elements).

According to the method for manufacturing a rare-earth magnet of the present invention, a modifier alloy used includes a low-melting RL-M alloy having a eutectic or a RL-rich hyper-eutectic composition (RL: one type or two types or more of light rare-earth elements, M: one type or two types or more of transition elements or typical metal elements and not including heavy rare-earth elements) and does not include a heavy rare-earth metal such as Dy or Tb, and such a modifier alloy is penetrant-diffused. Thereby, a rare-earth magnet with a high coercive force, especially a coercive force under a high-temperature environment (e.g., 150 to 200° C.) and that is relatively highly-magnetized can be manufactured.

Herein, the RL-M alloy used is preferably a RE-Y alloy (Y: a metal element and not including heavy rare-earth elements). That is, an alloy containing at least one type of Nd and Pr is preferably used.

Exemplary rare-earth magnets as a manufacturing target of the manufacturing method of the present invention include not only a nano-crystalline magnet including a main phase (crystal grains) making up the structure of 200 nm or less in grain size but also that of 300 nm or more in grain size, as well as a sintered magnet of 1 μm or more in grain size, a bond magnet including crystal grains bonded with resin binder and the like. Among them, the manufacturing method of the present invention is suitable for a nano-crystalline magnet. This is because when the nano-crystalline magnet is manufactured by a conventional manufacturing method using a modifier alloy containing a high-melting heavy rare-earth metal, the problem of coarsening of crystal grains occurs. On the other hand, according to the present invention, a relatively low-melting modifier alloy of 700° C. or lower is used for the modification of a grain boundary phase, and therefore such a problem does not occur.

Firstly, a melt-spun ribbon (rapidly quenched ribbon) as fine crystal grains is prepared by rapid-quenching of liquid, and the melt-spun ribbon is coarse-ground, for example, to prepare magnetic powder for rare-earth magnet. This magnetic powder is loaded into a dice, for example, and is sintered while applying pressure thereto with a punch to be a bulk, thus forming an isotropy compact including a RE-Fe—B main phase of a nano-crystal structure (RE: at least one type of Nd and Pr, and more specifically any one type or two types or more of Nd, Pr, Nd—Pr) and a RE-X alloy (X: metal element) grain boundary phase surrounding the main phase (First step).

In this compact, the RE-X alloy making up the grain boundary phase may be an alloy containing, when RE is Nd, Nd and at least one type of Co, Fe, Ga and the like, which may vary with the ingredients of the main phase. For instance, the RE-X alloy may be any one type of Nd—Co, Nd—Fe, Nd—Ga, Nd—Co—Fe and Nd—Co—Fe—Ga or the mixture of two types or more of them, and is in a Nd-rich state. When RE is Pr, similarly to Nd, the alloy is in a Pr-rich state.

Next, a modifier alloy including a RE-Y alloy having a eutectic or a RE-rich hyper-eutectic composition (Y: a metal element and not including a heavy rare-earth element) is brought into contact with the compact, followed by heat treatment at a temperature of a melting point of the modifier alloy or higher, thus penetrant-diffusing the melt thereof through a surface of the compact. Whereby, the melt of the RE-Y alloy is sucked in the grain boundary phase, and a rare-earth magnet with an improved coercive force can be manufactured, while changing the internal structure of the compact. Herein, in order to bring the modifier alloy into contact with the compact, the modifier alloy processed into a chip or a block in a desired shape or dimensions may be brought into contact with the compact.

Note here that, in the case of RE-Y eutectic composition, since a lot of Y elements are contained, a larger amount of Fe in the main phase will be substituted, thus degrading magnetic properties of the main phase. Further since RE has affinity for the main phase than Y elements, a RE-rich composition is preferable to suppress distortion that adversely affects magnetic properties. That is, a hyper-eutectic composition with less Y elements leads to a higher modification effect.

Note here that, in the second step, after hot deformation processing to give anisotropy to the compact prepared at the first step, the modifier alloy may be brought into partially contact with such a compact. In that case, a rare-earth magnet manufactured can have not only excellent coercivity performance but also excellent magnetization performance.

Preferable examples of the modifier alloy having a eutectic or a rare-earth rich hyper-eutectic composition include any one type of a Nd—Cu alloy, a Nd—Al alloy, a Pr—Cu alloy, a Pr—Al alloy, a Nd—Pr—Cu alloy and a Nd—Pr—Al alloy, and among them a Nd—Pr—Cu ternary alloy and a Nd—Pr—Al ternary alloy are preferable.

In the case of a Nd—Cu alloy, exemplary compositions of the Nd—Cu alloy having a eutectic or a Nd-rich hyper-eutectic composition include 70 at % Nd-30 at % Cu, 80 at % Nd-20 at % Cu, 90 at % Nd-10 at % Cu and 95 at % Nd-5 at % Cu.

A Nd—Cu alloy has a melting point of about 520° C., a Pr—Cu alloy has a melting point of about 480° C., a Nd—Al alloy has a melting point of about 640° C. and a Pr—Al alloy has a melting point of about 650° C., all of which is greatly below 700 to 1,000° C. that causes coarsening of crystal grains making up a nano-crystalline magnet.

Herein, in the comparison between a Nd—Cu alloy and a Pr—Cu alloy, for example, a Pr—Cu alloy is preferably used as the modifier alloy from the viewpoints of reactivity with the grain boundary phase, the grain boundary diffusion rate and the like.

When the modifier alloy is brought into contact with the compact, followed by heat treatment to penetrant-diffuse the melt thereof, the melt penetrates inside the magnetic powder through the interface of the magnetic powder making up the compact, thus penetrating into the grain boundary phase making up the magnetic powder and exerting the modification effect thereof at the grain boundary phase. At this time, the Nd—Cu alloy at the melting point or higher proceeds while reacting with a Nd-rich phase (existing at the interface of the magnetic powder and at the grain boundary phase in the magnetic powder) in the magnetic powder. In order to generate this modification reaction at a center part away from the surface of the magnetic powder (magnet), an appropriate heat treatment temperature, e.g., about 560° C. to 580° C. has to be kept for a long time, or heat treatment has to be performed at a temperature higher than the appropriate heat treatment temperature. When heat treatment is performed at 580° C., for example, a problem occurs such that Fe component as a part of the main phase is eluted at the grain boundary phase, thus lowering the coercive force. Therefore in the case of heat treatment at a higher temperature, this problem becomes more pronounced. Such elution of Fe component as a part of the main phase increases Fe concentration at the grain boundary phase, thus directly causing deterioration in coercive force.

In view of this point, compared with a Nd—Cu alloy, a low-melting alloy such as a Pr—Cu alloy containing a Pr group has more favorable reactivity with the grain boundary phase and its penetrant-diffusion rate is faster, and therefore the above problem can be effectively solved. That is, a heat treatment temperature can be lowered by using a low-melting modifier alloy, and so the modifier alloy can be grain-boundary diffused while suppressing the elution of the main phase. As a result, a high coercivity rare-earth magnet can be manufactured.

Meanwhile, Pr elements have a high penetrant-diffusion rate because the magnetic powder as the diffusion target contains a very small amount of Pr elements therein and the concentration gradient of Pr becomes large when a Pr—Cu alloy or the like is used as the modifier alloy. On the other hand, when a Nd—Cu alloy is used for the modifier alloy, a large amount of Nd exists in the magnetic powder, and therefore the concentration gradient of Nd becomes small. Therefore, Nd elements have a relatively low penetrant diffusion rate. For this reason, Pr elements and Nd elements are different in the penetrant diffusion rate.

The present inventors verified that when an alloy containing a Pr group to be used as the modifier alloy is heat treated in the temperature range of 480 to 580° C., the penetrant diffusion distance becomes long and accordingly the rare-earth magnet obtained can have a higher coercive force. As a temperature of the heat treatment is lower, a base material is less damaged, i.e., the elution amount of Fe from the main phase to the grain boundary phase becomes less, thus reducing deterioration of a coercive force as well as reducing the growth of crystal grains. A lower temperature of the heat treatment, however, requires a time to achieve the modification effect. Accordingly, with consideration given to these factors comprehensively, a practical temperature may be set. More specifically, the temperature may be set at 580° C. or lower or less than 580° C., or 480° C. to 560° C.

Further a Nd—Pr—Cu alloy, a Nd—Cu alloy and a Pr—Cu alloy are compared as follows. As described later, their coercive forces are organized with the Kronmuller formula. In the case of the Nd—Cu alloy and the Pr—Cu alloy, any one of a $N_{eff}$ value and an $\alpha$ value changes so as to increase a coercive force at high temperatures. On the other hand, in the case of the Nd—Pr—Cu alloy, both of the values change so as to increase a coercive force at high temperatures. As a result, in comparison of these alloys with the same amount of modifier alloy, the Nd—Pr—Cu alloy has a higher modification effect, and therefore a Nd—Pr—Y alloy (Y: a metal element and not including a heavy rare-earth element) including the Nd—Pr—Cu alloy is preferably used. In this way, the method for manufacturing a rare-earth magnet of the present invention is based on a novel technical idea of using a relatively low-melting modifier alloy not including a heavy rare-earth metal such as Dy or Tb and having a eutectic or a rare-earth element rich hyper-eutectic composition, and penetrant-diffusing the modifier alloy to the grain boundary phase. With this method, in the case of a nano-crystalline magnet as a rare-earth magnet, for example, crystal grains can be separated magnetically at the modified grain boundary phase while suppressing coarsening of the nano-crystal grains, and so a rare-earth magnet with excellent coercivity performance can be obtained.

Effects of the Invention

As can be understood from the above description, the method for manufacturing a rare-earth magnet of the present invention uses a relatively low-melting modifier alloy not including a heavy rare-earth metal such as Dy or Tb and having a eutectic or a rare-earth element rich hyper-eutectic composition and penetrant-diffuses the modifier alloy. Thereby, penetrant-diffusion to the grain boundary phase can be promoted at a low manufacturing cost (material cost), and a rare-earth magnet with excellent coercivity performance, especially under a high-temperature atmosphere (e.g., 150 to 200° C.) can be manufactured.

DESCRIPTION OF A PREFERRED EMBODIMENT OF THE INVENTION

In the following, an embodiment of a method for manufacturing a rare-earth magnet of the invention is described with reference to the drawings. Although the illustrated example describes a method for manufacturing a rare-earth magnet that is a nano-crystalline magnet, the method for manufacturing a rare-earth magnet of the present invention is not limited to the manufacturing of a nano-crystalline magnet, and should be applicable to the manufacturing of a sintered magnet having relatively large crystal grains. The present invention may be a method for manufacturing a rare-earth magnet having a coercive-force distribution, the method including the step of partially penetrant-diffusing the melt of a modifier alloy at a desired portion of a compact obtained through a first step and not performing hot deformation processing.

(Method for Manufacturing Rare-Earth Magnet)

Figure 1A:
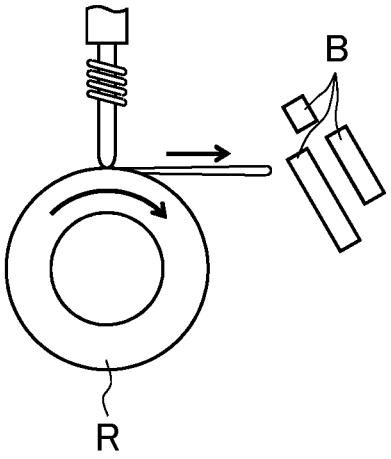
FIGS. 1A and B schematically illustrate, in this stated order, a first step of a method for manufacturing a rare-earth magnet of the present invention.
Figure 1B:
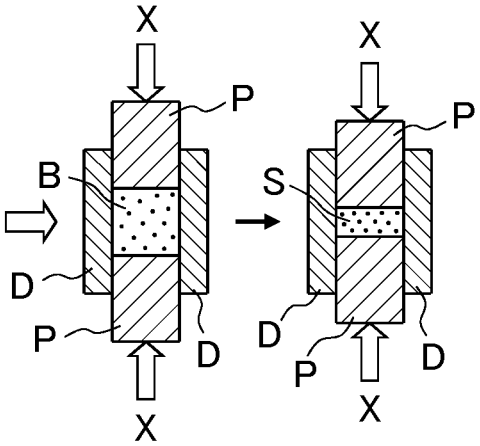
Figure 2:
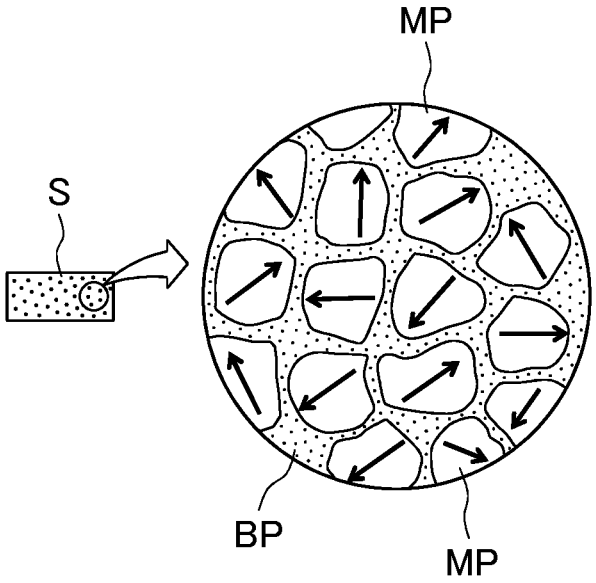
FIG. 2 illustrates a micro-structure of a compact illustrated in FIG. 1B.
Figure 3:
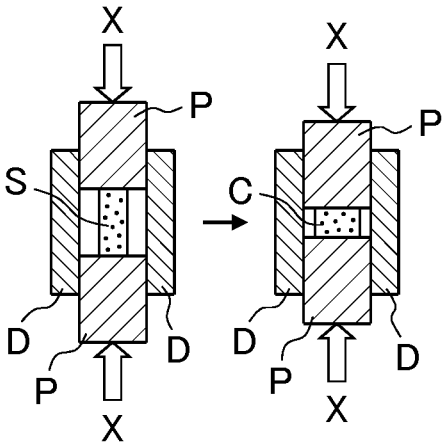
FIG. 3 illustrates a second step of the manufacturing method.
Figure 4:
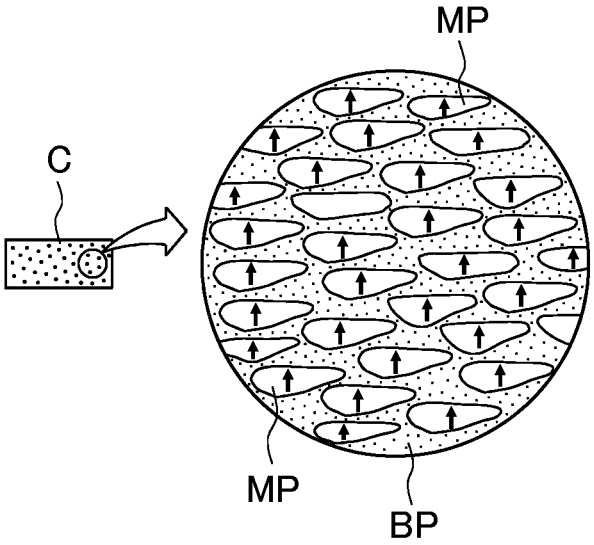
FIG. 4 illustrates a micro-structure of a rare-earth magnet precursor of FIG. 3.
Figure 5:
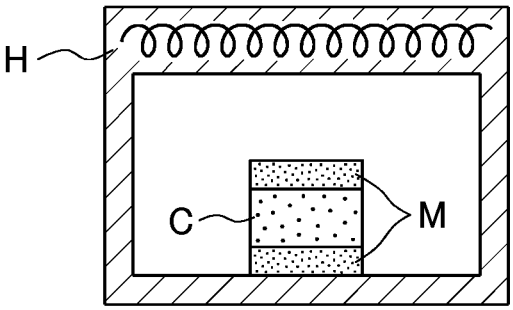
FIG. 5 illustrates a second step of the manufacturing method to be performed following FIG. 3.
Figure 7:
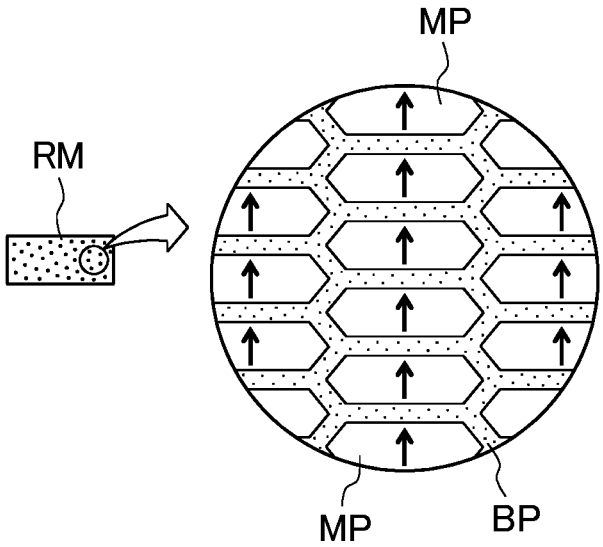
FIG. 7 illustrates a micro-structure of a rare-earth magnet manufactured.

FIGS. 1A and B schematically illustrate, in this stated order, a first step of a method for manufacturing a rare-earth magnet of the present invention, and FIGS. 3 and 5 illustrate, in this stated order, a second step of the manufacturing method. FIG. 2 illustrates a micro-structure of a compact illustrated in FIG. 1B, and FIG. 4 illustrates a micro-structure of a rare-earth magnet precursor of FIG. 3. FIG. 7 illustrates a micro-structure of a rare-earth magnet manufactured.

As illustrated in FIG. 1A, alloy ingot is molten at a high frequency, and a molten composition giving a rare-earth magnet is injected to a copper roll R to manufacture a melt-spun ribbon B by a melt-spun method using a single roll in an oven (not illustrated) under an Ar gas atmosphere at reduced pressure of 50 kPa or lower, for example. The melt-spun ribbon obtained is coarse-ground.

As illustrated in FIG. 1B, the coarse-ground melt-spun ribbon B is loaded in a cavity defined by a carbide dice D and a carbide punch P sliding along the hollow of the carbide dice. Then, ormic-heating is performed thereto while applying pressure with the carbide punch P (X direction) and letting current flow through in the pressuring direction, whereby a compact S is manufactured, including a Nd—Fe—B main phase (having the grain size of about 50 nm to 200 nm) of a nano-crystalline structure and a Nd—X alloy (X: metal element) grain boundary phase around the main phase (First step).

Herein, the Nd—X alloy making up the grain boundary phase is an alloy containing Nd and at least one type of Co, Fe, Ga and the like, which may be any one type of Nd—Co, Nd—Fe, Nd—Ga, Nd—Co—Fe, Nd—Co—Fe—Ga, or the mixture of two types or more of them and is in a Nd-rich state.

As illustrated in FIG. 2, the compact S shows a crystalline structure where the space between the nano-crystalline grains MP (main phase) is filled with the grain boundary phase BP.

Then, in order to give anisotropy to this compact S, as illustrated in FIG. 3 as a second step, the carbide punch P is brought into contact with end faces of the compact S in the longitudinal direction (In FIG. 1B, the horizontal direction is the longitudinal direction), and hot deformation processing is performed thereto while applying pressure with the carbide punch P (X direction), whereby a rare-earth magnet precursor C in the crystalline structure including anisotropic nano-crystalline grains MP is manufactured as shown in FIG. 4.

When the degree of processing (compression rate) by the hot deformation processing is large, e.g., when the compression rate is about 10% or higher, such a processing may be called hot heavily deformation processing or simply called heavily deformation processing.

In the crystalline structure of the rare-earth magnet precursor C illustrated in FIG. 4, the nano-crystalline grains MP have a flattened shape, and a boundary face substantially in parallel to the anisotropic axis is curved or bent.

Next, as illustrated in FIG. 5, the thus manufactured rare-earth magnet precursor C is placed in a high-temperature oven H having a built-in heater. Blocks M of a modifier alloy are placed and brought into contact with the rare-earth magnet precursor C from above and below, and the inside of the oven is set at a high-temperature atmosphere.

Herein, the modifier alloy M used may be a RE-Y alloy (RE: at least one type of Nd and Pr, Y: transition metal element) not including heavy rare-earth elements. The transition metal element Y used may be any one type of Cu and Al, which means that the RE-Y alloy used may be any one type of a Nd—Cu alloy, a Nd—Al alloy, a Pr—Cu alloy and a Pr—Al alloy.

Such exemplified alloys used as the RE-Y alloy have eutectic points of 520° C. for the Nd—Cu alloy, 480° C. for the Pr—Cu alloy, 640° C. for the Nd—Al alloy and 650° C. for the Pr—Al alloy, all of which are a low melting point of 700° C. or lower.

When a Nd—Cu alloy is used as the modifier alloy M, since the eutectic point thereof is 520° C., the Nd—Cu alloy as the modifier alloy is molten by setting the inside of the high-temperature oven H at a temperature environment of about 520° C. or higher (e.g., at about 600° C.).

The molten Nd—Cu alloy liquid is penetrant-diffused into the grain boundary phase BP, so that a part or all of the grain boundary phase containing Nd—Co, Nd—Fe, Nd—Ga, Nd—Co—Fe and Nd—Co—Fe—Ga and the mixture thereof is modified with the Nd—Cu alloy, thus forming a modified grain boundary phase.

When a Nd—Al alloy is used as the modifier alloy M, since the melting point thereof is 640 to 650° C., the Nd—Al alloy is molten under a temperature environment of 640 to 650° C., and then the molten liquid can be penetrant-diffused into the grain boundary phase. A part or all of the grain boundary phase containing Nd—Co, Nd—Fe, Nd—Ga, Nd—Co—Fe and Nd—Co—Fe—Ga and the mixture thereof is modified with the Nd—Al alloy, thus forming a modified grain boundary phase.

In this way, a block M of a modifier alloy having a low melting point of 700° C. or lower is used and is molten at a low temperature, whereby the problematic coarsening, which occurs when a nano-crystalline magnet is placed under a high-temperature atmosphere of 800° C. or higher, will not occur.

Figure 6A:
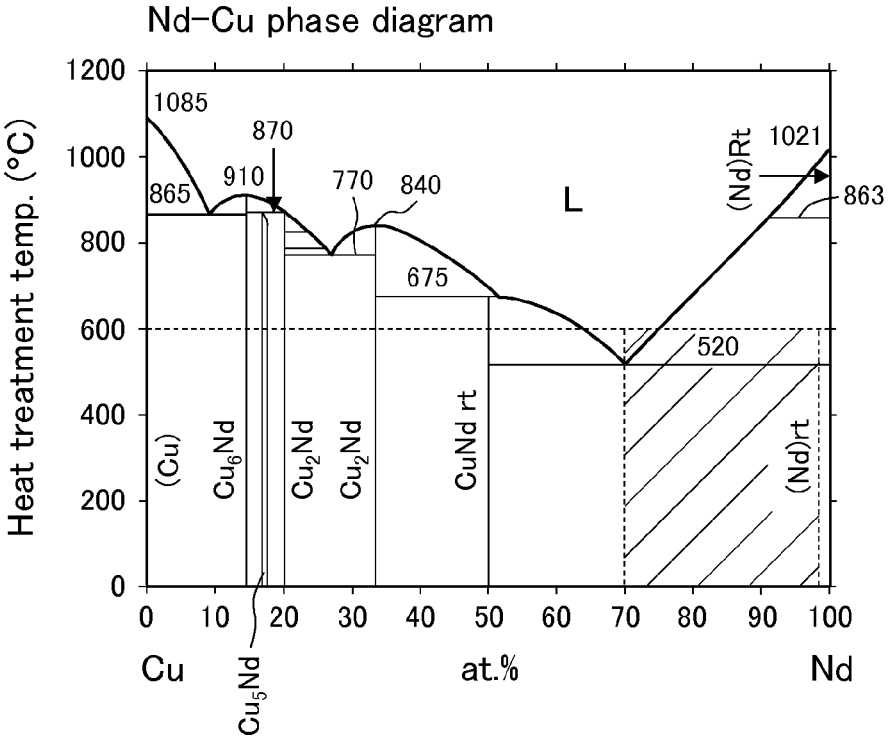
FIG. 6A is a phase diagram of Nd—Cu, indicating the range of Nd used in the manufacturing method of the present invention.
Figure 6B:
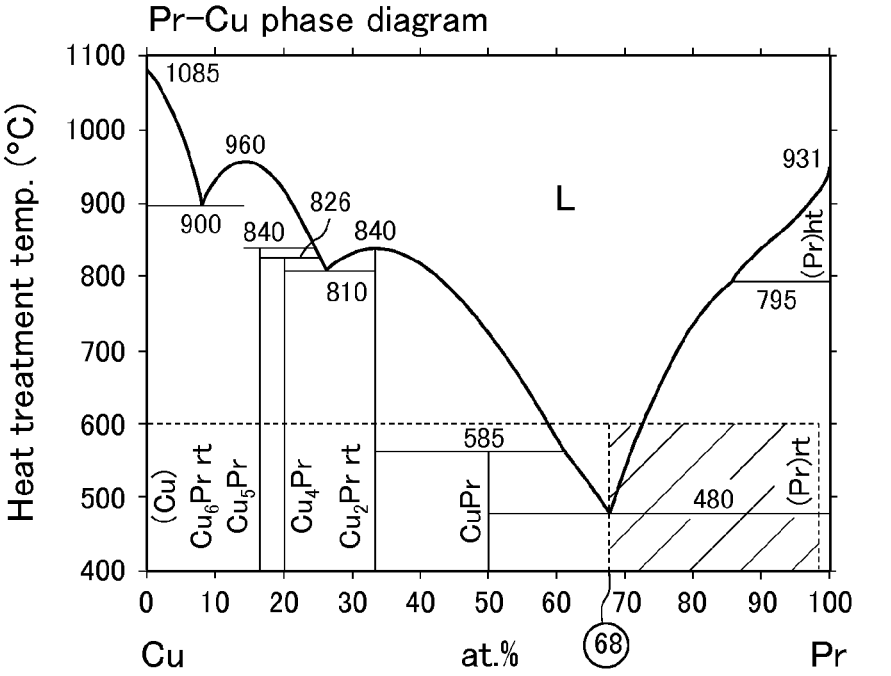
FIG. 6B is a phase diagram of Pr—Cu, indicating the range of Pr used in the manufacturing method of the present invention.

The present manufacturing method uses, as the Nd—Cu alloy, the Nd—Al alloy, the Pr—Cu alloy and the Pr—Al alloy, a modifier alloy M containing Nd or Pr as rare-earth elements and having a eutectic or a rare earth-rich hyper-eutectic composition. FIG. 6A is a phase diagram of a Nd—Cu alloy and FIG. 6B is a phase diagram of a Pr—Cu alloy.

In the case of a Nd—Cu alloy, a modifier alloy containing Nd of 70 at % or more and having a eutectic or a hyper-eutectic composition is used (in the drawing, the hatched range surrounded by a heat treatment temperature: 600° C. and the range containing Nd of 70 at % or more and 98 at % or less).

In the case of a Pr—Cu alloy, a modifier alloy containing Pr of 68 at % or more and having a eutectic or a hyper-eutectic composition is used (in the drawing, the hatched range surrounded by a heat treatment temperature: 600° C. and the range containing Pr of 68 at % or more and 98 at % or less).

Any one of these Nd—Cu alloy, Nd—Al alloy, Pr—Cu alloy and Pr—Al alloy having a eutectic or a rare-earth rich hyper-eutectic composition is used, and heat treatment is performed at a temperature of 600° C. or higher and 700° C. or lower for a predetermine time, whereby as illustrated in FIG. 7, a rare-earth magnet RM is manufactured where the grain boundary phase BP is modified into a Nd or Pr rich composition (Second step).

As illustrated in this drawing, when modification by the modifier alloy M sufficiently proceeds, an interface (specific face) that is substantially in parallel to the anisotropic axis is formed. In this way, according to the above manufacturing method, molten liquid of a modifier alloy of a low melting point of 700° C. or lower is penetrant-diffused into a grain boundary phase of a rare-earth magnet precursor C, the rare-earth magnet precursor C being obtained by performing hot deformation processing to a compact S to give anisotropy thereto. As a result, the residual distortion generated by the hot deformation processing can be removed by coming into contact with the molten liquid of the modifier alloy, and further crystal grains are made finer and magnetic separation between crystal grains is promoted, and therefore a coercive force of the magnet is improved. Especially a modifier alloy having a low melting point and having a eutectic or a rare-earth rich hyper-eutectic composition used enables favorable formation of the rare-earth elements-based grain boundary phase, thus enabling increase in a coercive force.

[Experiments to Find a Relation Between Heat Treatment Time and Coercive Forces of Manufactured Rare-Earth Magnets and Experimental Result]

The present inventors prepared rare-earth magnets (Examples) using Nd—Cu alloys and Pr—Cu alloys having a eutectic or a rare-earth rich hyper-eutectic composition by the manufacturing method of the present invention while changing the composition ratio of the rare-earth elements. In this experiment, the modifier alloy 70 at % Nd-30 at % Cu was used in Example 1, the modifier alloy 80 at % Nd-20 at % Cu was used in Example 2, the modifier alloy 90 at % Nd-10 at % Cu was used in Example 3, the modifier alloy 95 at % Nd-5 at % Cu was used in Example 4 and the modifier alloy 90 at % Pr-10 at % Cu was used in Example 5. Meanwhile, a Nd—Cu alloy (60 at % Nd-40 at % Cu) having a rare-earth hypo-eutectic composition was used to prepare a rare-earth magnet as a comparative example.

Figure 8:
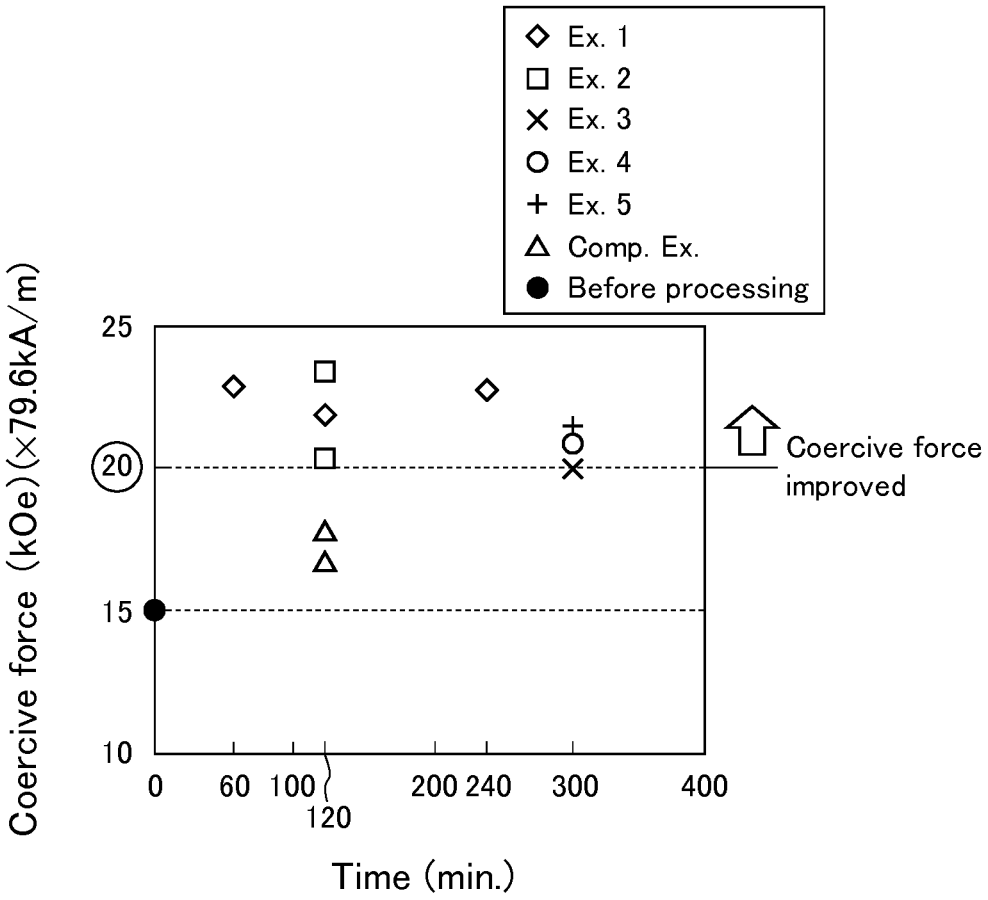
FIG. 8 shows an experimental result about a relation between heat treatment time in the second step and coercive forces of rare-earth magnets manufactured.

During manufacturing of the rare-earth magnets, the ratio of a modifier alloy with reference to the rare-earth magnet as a whole was adjusted at 5 to 10 mass %, and heat treatment was performed in the range of 600 to 700° C. under a vacuum atmosphere (less than $1.3\times10^{-3}$ Pa), and rare-earth magnets as Examples and Comparative Example were manufactured while changing the heat treatment time from 1 to 5 hours. Then, their coercive forces were measured with a vibrating sample magnetometer (VSM). The following Table 1 partially shows the conditions of Examples and Comparative Example and the measurement result of the coercive forces, and FIG. 8 shows coercive-force measurement results of all test pieces.

TABLE 1

| | Composition ratio | Modifier alloy ratio (mass %) | Heat treatment temp. (° C.) | Heat treatment time (min.) | Coercive force (kOe) |
|---|---|---|---|---|---|
| Ex. 1 | 70at % Nd—30at % Cu | 10 | 600 | 60 | 22.9 |
| | | | | 120 | 21.9 |
| | | | | 240 | 22.7 |
| Ex. 2 | 80at % Nd—20at % Cu | 10 | 625 | 120 | 23.4 |
| | | | 650 | | 20.5 |
| Ex. 3 | 90at % Nd—10at % Cu | 10 | 650 | 120 | 20.0 |
| Ex. 4 | 95at % Nd—5at % Cu | 10 | 600 | 300 | 21.0 |
| Ex. 5 | 90at % Pr—10at % Cu | 10 | 600 | 300 | 21.5 |
| Comp. Ex. | 60at % Nd—40at % Cu | 10 | 650 | 120 | 17.9 |
| | | 5 | | | 16.9 |

Herein, the values of the coercive force in Table 1 can be converted into the values in the SI unit (kA/m) by multiplying by 79.6 thereto.

Table 1 and FIG. 8 demonstrate that the coercive force of Comparative Example remained in improvement to less than 18 kOe from 15 kOe prior to the penetrant-diffusion of the modifier alloy, whereas the coercive forces of Examples 1 to 5 all were improved to a high coercive force of 20 kOe or higher. Presumably, this is because temperature conditions and time for heat treatment were preferable and modifier alloys having rare-earth rich hyper-eutectic composition allowed the rare-earth element based grain boundary phase to be formed favorably.

[Experiment to Verify Modification Effect Using Modifier Alloy Containing Pr Group and Experimental Result]

The present inventors prepared rare-earth magnets (test pieces) as Examples 6 to 8 and Reference Examples 1 to 3 by the following method, and conducted an experiment to verify the modification effect by the modifier alloys containing Pr group among the modifier alloys used.

Example 6

The following describes a method for manufacturing a test piece step by step.

(1) A predetermined amount of rare-earth alloy raw materials (the alloy composition was 29.8Nd-0.2Pr-4Co-0.9B-0.6Ga-bal.Fe in the units of at %) were mixed, which was then molten in an Ar gas atmosphere, followed by injection of the molten liquid thereof from an orifice to a revolving roll made of Cu with Cr plating applied thereto for quenching, thus preparing alloy thin pieces.

(2) 8.4 grams of this rare-earth alloy powder was placed in a forming die of ϕ10×40 mm in volume made up of a carbide dice and a carbide punch, followed by sealing.

(3) The forming die was set at a chamber, and a pressure inside of the chamber was reduced to $10^{-2}$ Pa. Then load of 400 MPa was applied thereto while heating to 650° C. by a high-frequency coil for press working. The state after press working was held for 60 seconds, and a compact (bulk) was taken out from the forming die. The compact had a height of 14 mm.

(4) Next, an oxygen-free copper ring separately prepared of ϕ12.5 mm in outer diameter, ϕ10 mm in inner diameter and 14 mm in height was fitted to the compact, and hot deformation processing was performed under the conditions of the heating temperature at 750° C., the processing rate of 75% and the strain rate of 7.0/s. Herein, BN lubricating release agent was applied to the surfaces of the punch.

(5) From the specimen subjected to hot deformation processing, a sample of 4.0×4.0×2.0 mm in size was cut out, which was used as a specimen for heat treatment.

(6) Next, as modifier alloys to be used for heat treatment, four types of modifier alloys including having compositions of 70Pr30Cu, 80Pr20Cu, 90Pr10Cu and 40Nd40Pr20Cu (all in the units of at %) were prepared, which were cut out to be samples of 4.0×4.0×0.1 mm in size. The oxide film on the surface of the samples was removed by filing, for example.

(7) The specimens prepared at steps (5) and (6) were placed in a case made of Ti in the order of the specimens prepared at step (6) and the specimens prepared at step (5).

(8) The inside of the case was set at a reduced-pressure atmosphere or an inert-gas atmosphere, and heat treatment was performed at 580° C. for 165 minutes to penetrant-diffuse the modifier alloys into the compact to prepare test pieces of the rare-earth magnets.

(9) Magnetic properties of the test pieces prepared at step (8) were estimated using a pulse magnetic measuring instrument and a vibrating sample magnetometer.

Reference Example 1

Reference Example 1 was prepared by using four types of modifier alloys having compositions of 70Nd30Cu, 80Nd20Cu, 90Nd10Cu and 95Nd5Cu instead of the modifier alloys described at step (6) in the above method for manufacturing Example 6, and other steps were similar to those of Example 6.

Example 7

Example 7 was prepared by using three types of modifier alloys having compositions of 70Pr30Cu, 80Pr20Cu and 90Pr10Cu for the modifier alloys described at step (6) in the above method for manufacturing Example 6, and heat treatment was performed under temperature conditions of 460° C., 480° C., 540° C. and 580° C. each for 165 minutes for those described at step (8). Other steps were similar to those of Example 6.

Reference Example 2

Reference Example 2 was prepared by using three types of modifier alloys having compositions of 70Nd30Cu, 80Nd20Cu and 90Nd10Cu for the modifier alloys described at step (6), and heat treatment was performed under temperature conditions of 540° C., 580° C. and 620° C. each for 165 minutes for those described at step (8). Other steps were similar to those of Example 6.

Example 8

Example 8 was prepared by using one type of modifier alloy having a composition of 90Pr10Cu for the modifier alloys described at step (6) in the above method for manufacturing Example 6, and heat treatment was performed under temperature conditions of 540° C. and 580° C. each for 165 minutes for those described at step (8). Other steps were similar to those of Example 6.

Reference Example 3

Reference Example 3 was prepared using a modifier alloy having a composition of 90Nd10Cu instead of the modifier alloys described at step (6) in the above method for manufacturing Example 8. The sizes of the specimens were 4.0×4.0×0.1 mm and 4.0×4.0×0.3 mm (the modification amount of three times the former sample) and heat treatment was performed at 580° C. for 165 minutes for those described at step (8). Other steps were similar to those of Example 8.

(Result 1 for Confirming the Effects)

Figure 9A:
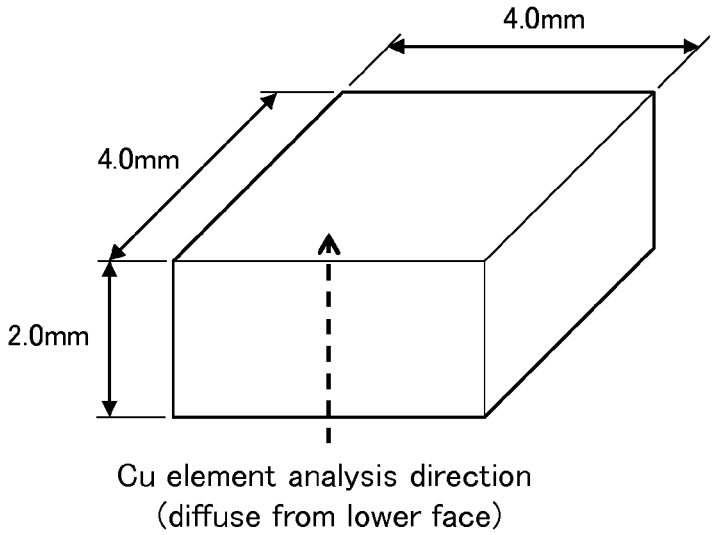
FIG. 9 relates to an experiment to verify a modification effect by modifier alloys containing Pr group, where FIG. 9A schematically illustrates a test piece
FIG. 9B shows a relation between penetrant distances of Cu elements making up the modifier alloy from the surface of the test piece and Cu concentration.
Figure 9B:
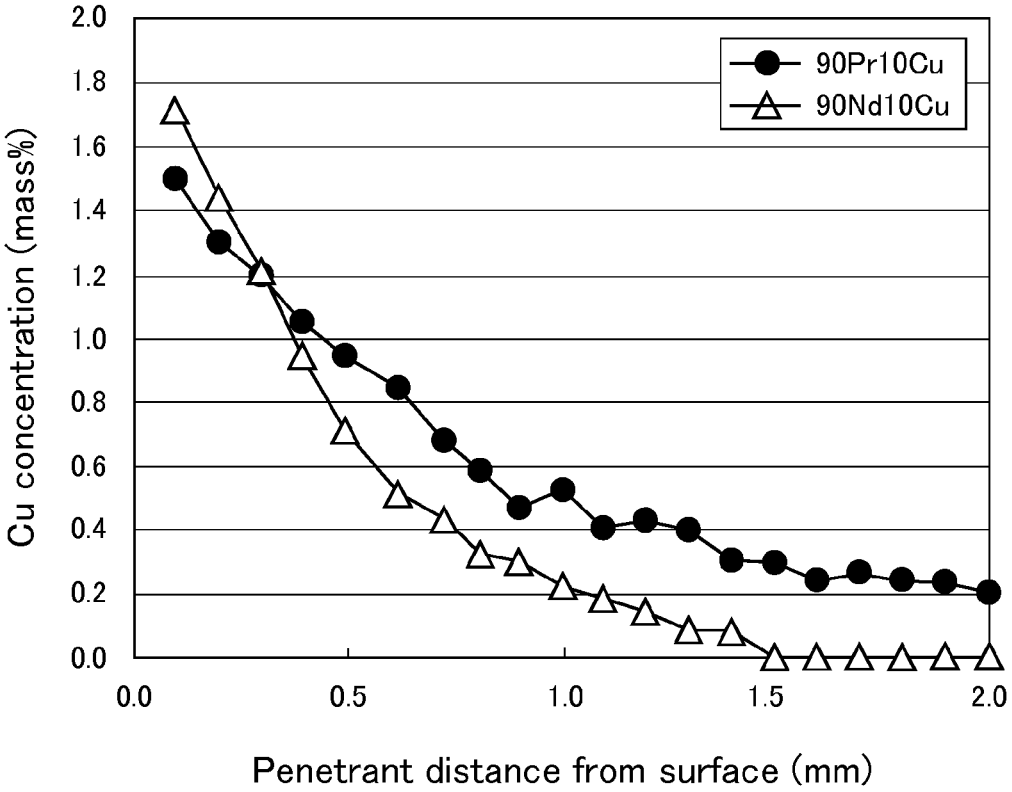
Figure 10:
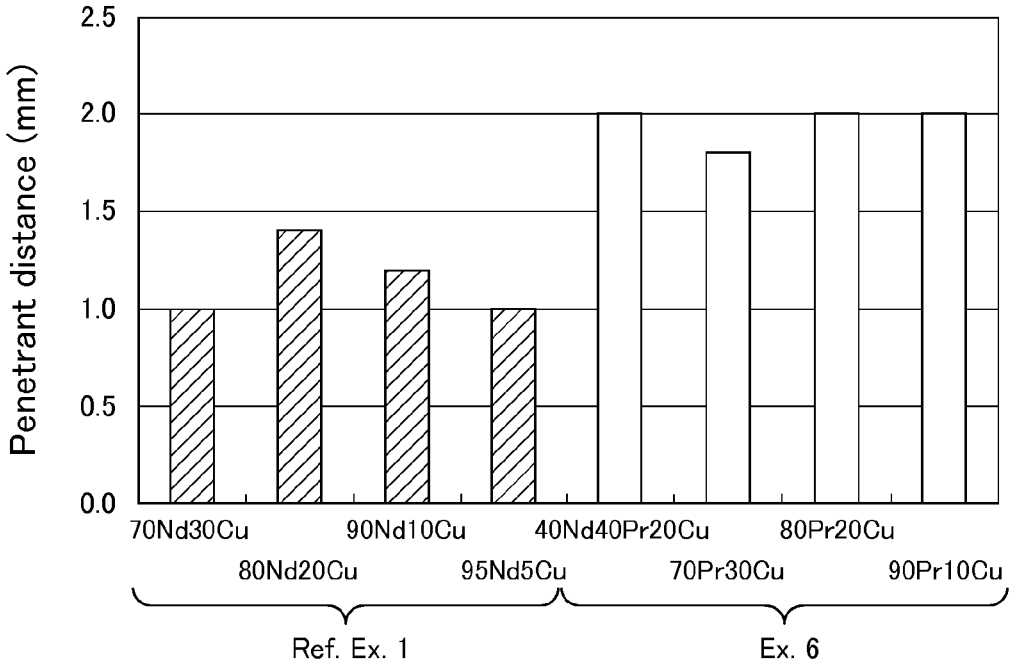
FIG. 10 shows a measurement result of penetrant distances of a Reference Example and an Example.

FIG. 9A schematically illustrates a test piece for Cu element analysis, and FIG. 9B illustrates a relation between a penetrant distance of Cu element making up a modifier alloy from the surface of the test piece and Cu concentration. FIG. 10 shows a measurement result of penetrant distances of Reference Example 1 and Example 6, and FIG. 11 shows a measurement result of coercive force of these examples.

Figure 11:
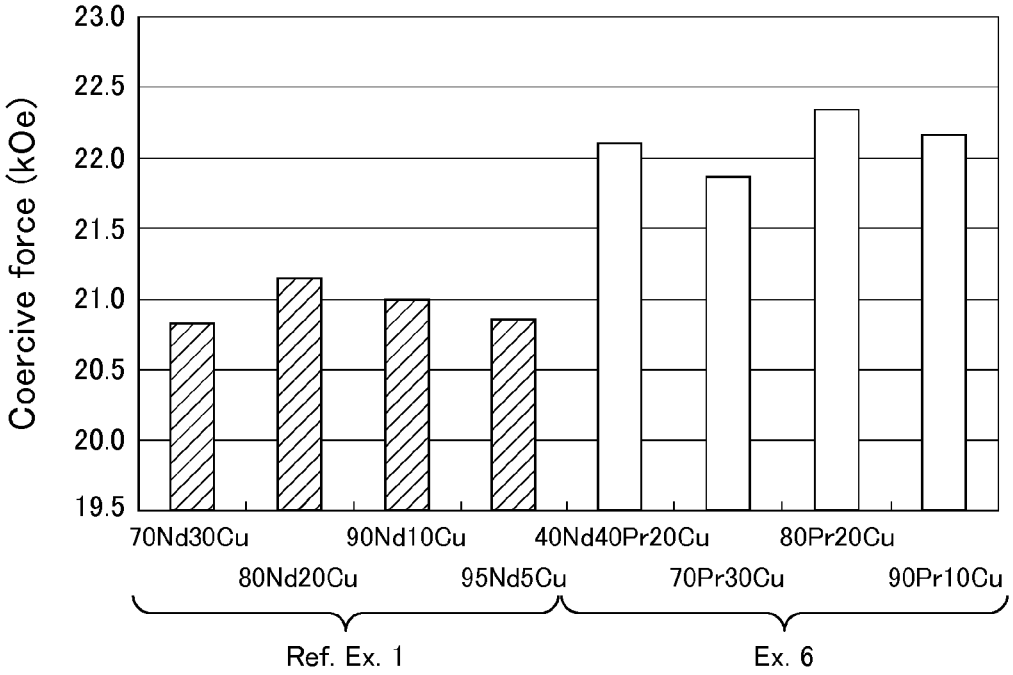
FIG. 11 shows a measurement result of coercive forces of the Reference Example and the Example.

It was confirmed from FIG. 11 that a Pr—Cu alloy used as a modifier alloy leads to a higher coercive force. Such a tendency is greatly influenced by the penetrant distances of modifier alloys shown in FIG. 10, and there is a correlation between the results of FIG. 10 and FIG. 11.

The penetrant distances and concentrations of the modifier alloys can be understood by element analysis from the modification plane to find the concentration of Cu elements as an alloy component. As shown by the result of FIG. 10 indicating the penetrant distances of the modifier alloys, as the penetrant distance becomes longer, a higher coercive force can be obtained. Especially, Nd—Cu alloys have a slower penetrant-diffusion rate than that of Pr—Cu alloys. That is, presumably, Nd—Cu alloys have relatively short penetrant distances, and therefore their coercive forces become low.

(Result 2 for Confirming the Effects)

Figure 12A:
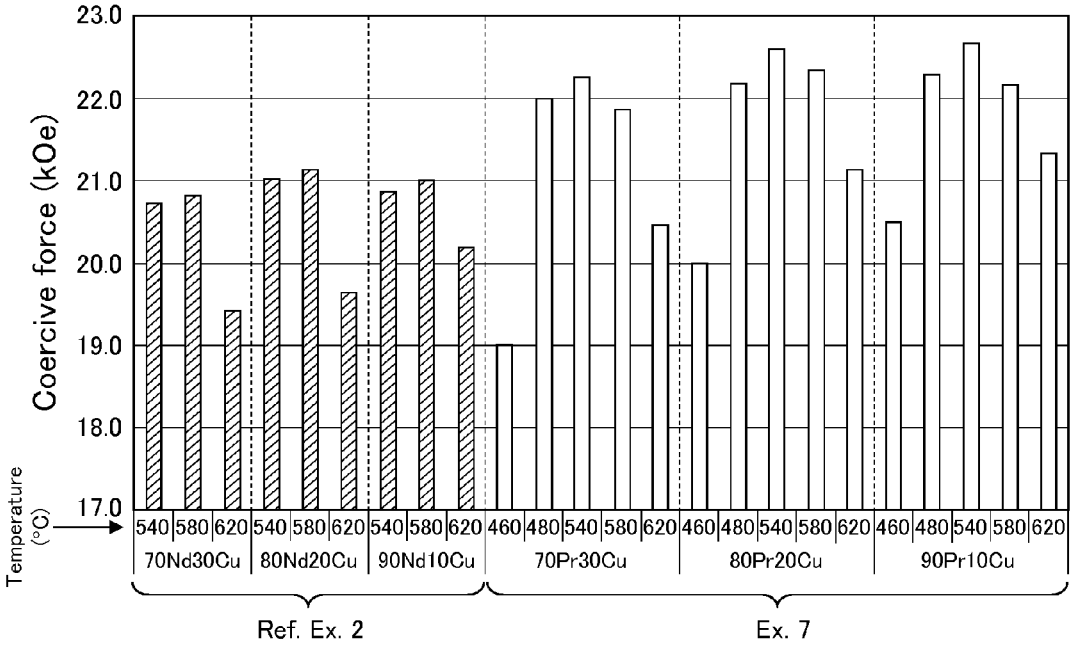
FIG. 12A shows a measurement result of coercive forces of a Reference Example and an Example for each heat treatment temperature.
Figure 12B:
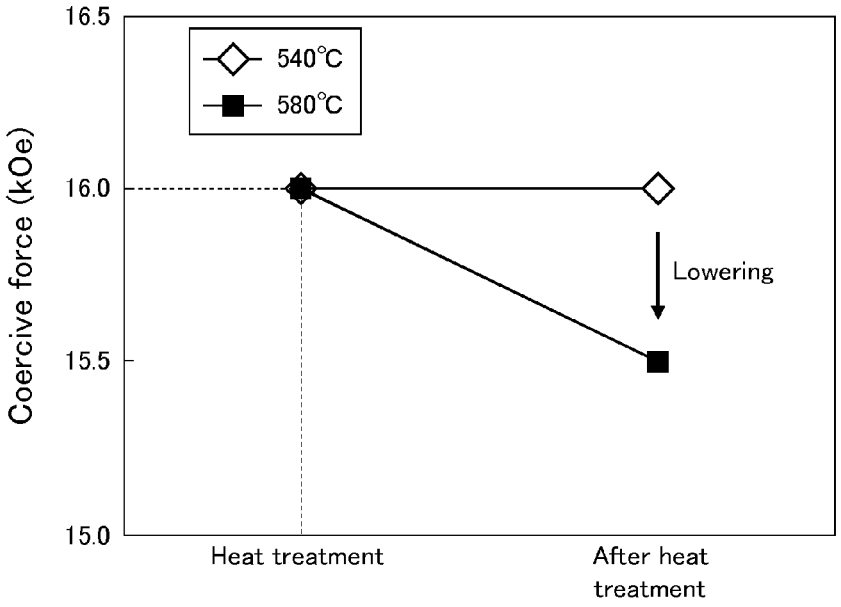
FIG. 12B shows a measurement result indicating the grounds of elution of a main phase.

FIG. 12A shows a measurement result of coercive forces of Reference Example 2 and Example 7 for each heat treatment temperature, and FIG. 12B shows a measurement result indicating the grounds of elution of a main phase.

Compared with the temperature conditions of 580° C. and 620° C., the test pieces treated at the temperature of 540° C. show higher coercive forces. In comparison of a difference in coercive force between 540° C. and 580° C., the test pieces including Pr—Cu alloys show a larger difference in coercive force than the test pieces including Nd—Cu alloys.

Presumably the test pieces subjected to modification processing at 580° C. and 620° C. show lower coercive forces than those at 540° C. because Fe components making up the main phase are eluted, resulting in an increase of Fe concentration at the grain boundary phase. This can be confirmed from FIG. 12B as well. That is, it was confirmed that while the test pieces treated at 580° C. decreased in their coercive forces, the test pieces treated to 540° C. hardly decreased in their coercive forces.

Presumably, the reason why the effect from the heat treatment temperature at 540° C. was relatively higher for Pr—Cu alloys resides in the melting points of the modifier alloys. That is, the Pr—Cu alloys have the melting point of 480° C. and there was a sufficient difference from the heat treatment temperature, thus enabling complete fusion of the modifier alloys. On the other hand, the Nd—Cu alloys have the melting point at 520° C. and the difference from the heat treatment temperature was just about 20° C., thus causing difficulty in complete fusion. As an evidence to support this, a part of the modifier alloy was not fused and remained at the test pieces after heat treatment. Presumably, such insufficient fusion caused insufficient modification, and so the coercive forces obtained were relatively low. It was further confirmed that the same happened for Pr—Cu alloys heat treated at 480° C. or lower.

(Result 3 for Confirming the Effects)

Figure 13A:
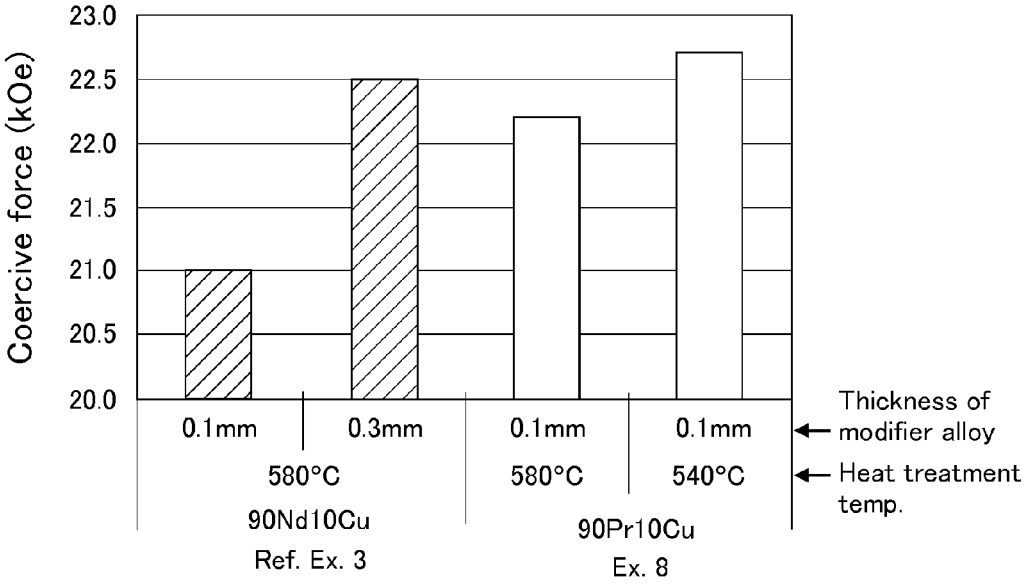
FIG. 13A shows a measurement result of coercive forces for modifier alloys having different thickness in a Reference Example and an Example.
Figure 13B:
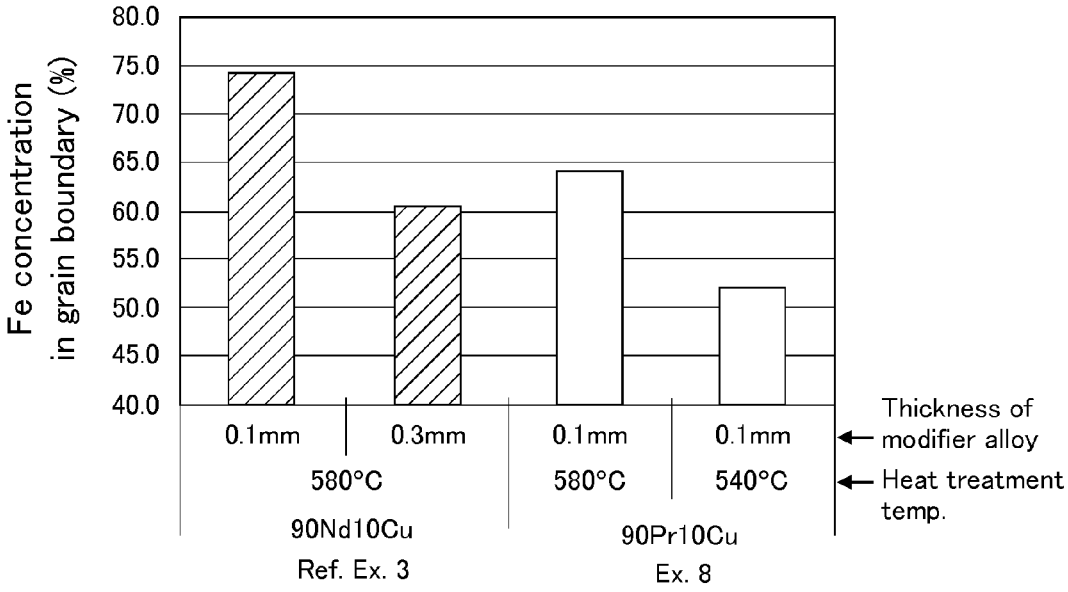
FIG. 13B shows a measurement result of Fe concentration at the grain boundary phase for modifier alloys having different thickness in the Reference Example and the Example.

FIG. 13A shows a measurement result of coercive forces for the modifier alloys having different thickness in Reference Example 3 and Example 8, and FIG. 13B shows a measurement result of Fe concentration at the grain boundary phase.

It was found from FIG. 13A that the Pr—Cu alloy led to a larger coercive force than the Nd—Cu alloy having the same modification amount (thickness). It was further confirmed that the Nd—Cu alloy and the Pr—Cu alloy having the thickness one third of the Nd—Cu alloy led to similar coercive forces. The reason why the Pr—Cu alloy with the same modification amount (thickness) led to a larger coercive force is because, presumably, since Nd exists in abundance in the magnet of the Nd—Cu alloy, a concentration difference is small, whereas since only a very small amount of Pr exists in the magnet, a concentration difference is large, thus increasing concentration gradient of Pr element and so increasing the penetrant-diffusion rate.

The reason why the Pr—Cu alloy heat treated at 540° C. having the modification amount (thickness) one third of the Nd—Cu alloy led to a similar coercive force is because, presumably, modification by the modifier alloy can be performed without elution of Fe in the main phase. Herein, although Fe is not eluted not only in the Pr—Cu alloy but also in the Nd—Cu alloy, penetrant-diffusion of the Nd—Cu alloy is relatively insufficient, which may lead to the difference in coercive force.

As shown in FIG. 13B, when the Nd—Cu alloy was modification-processed at 580° C., Fe concentration increased because of elution from the main phase in addition to the inherent Fe concentration at the grain boundary phase. Presumably in order to decrease the Fe concentration at the grain boundary phase, a required amount of modifier alloy was greatly increased.

[Experiment to Verify Modification Effect of Modifier Alloy Based on Nd and Pr and Experimental Result]

The present inventors prepared rare-earth magnets (test pieces) as Examples and Reference Examples by the following method, and conducted an experiment to verify modification effects by modifier alloys containing both of Nd and Pr among the modifier alloys to be used.

The following describes a method for manufacturing test pieces one by one.

Example 9

Example 9 was prepared by using two types of modifier alloys having compositions of 40Nd40Pr20Cu and 20Nd60Pr20Cu for the modifier alloys described at step (6) in the above method for manufacturing Example 6, and other steps were similar to those of Example 6.

Reference Example 4

Reference Example 4 was prepared by using two types of modifier alloys having compositions of 80Nd20Cu and 80Pr20Cu for the modifier alloys described at step (6) in the above method for manufacturing Example 6, and other steps were similar to those of Example 6.

Example 10

Example 10 was prepared by using two types of modifier alloys having compositions of 40Nd40Pr20Cu and 20Nd60Pr20Cu for the modifier alloys described at step (6) in the above method for manufacturing Example 6, and three type of pieces in size were cut out, having the weight of 2.5 mass %, 5.0 mass % and 10.0 mass % as the base material weight. Other steps were similar to those of Example 6.

Reference Example 5

Reference Example 5 was prepared by using two types of modifier alloys having compositions of 80Nd20Cu and 80Pr20Cu for the modifier alloys described at step (6) in the above method for manufacturing Example 10, and other steps were similar to those of Example 10.

(Result 1 for Confirming the Effects)

Figure 14:
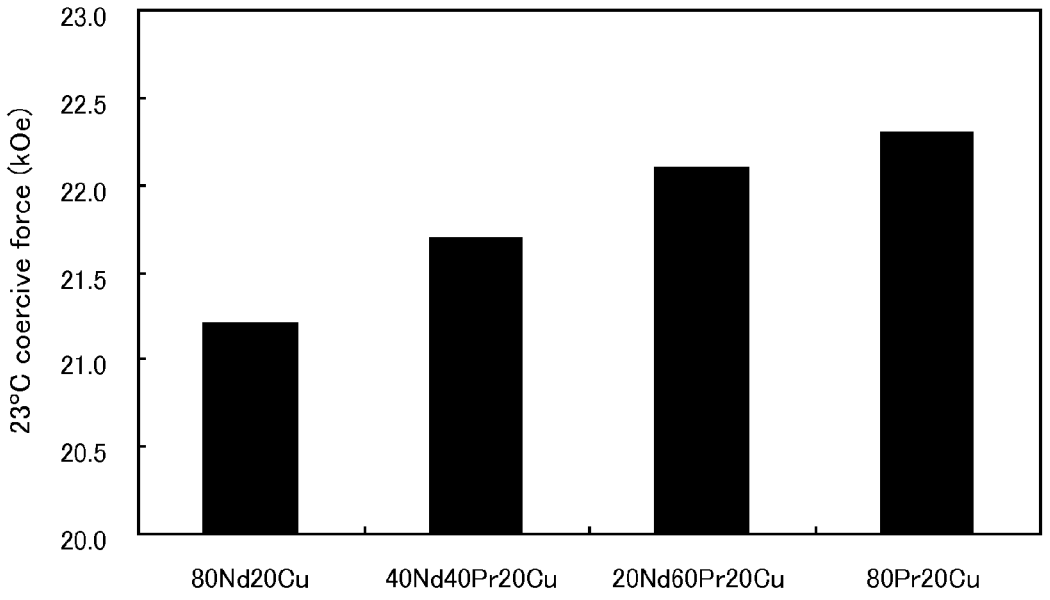
FIG. 14 shows an experimental result to verify a modification effect by modifier alloys, indicating a result of the coercive forces at 23° C. for a Reference Example and an Example.
Figure 15:
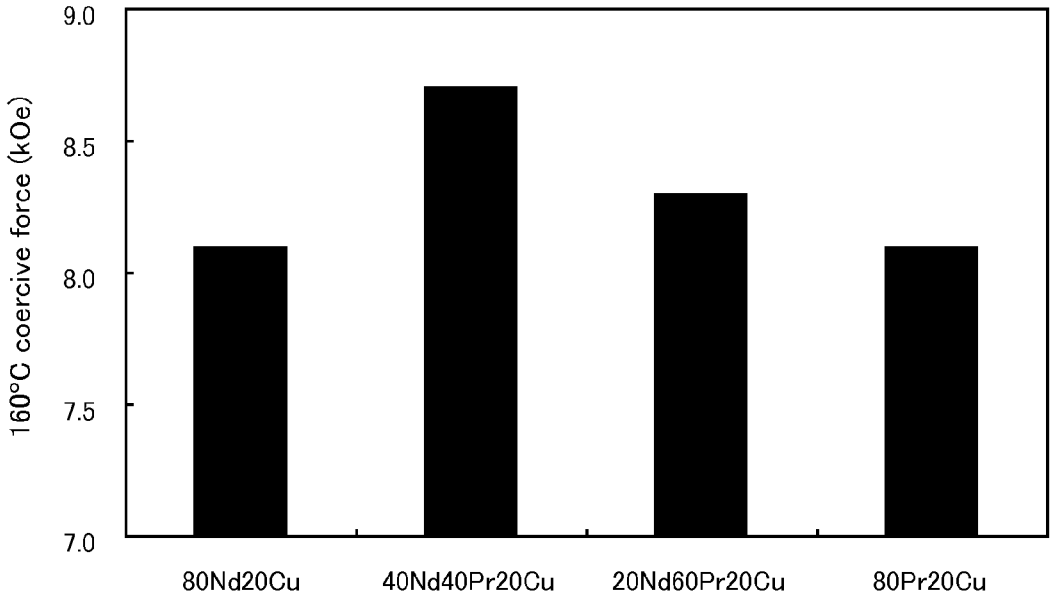
FIG. 15 shows an experimental result to verify a modification effect by modifier alloys, indicating a result of the coercive forces at 160° C. for a Reference Example and an Example.

FIG. 14 and FIG. 15 show coercive forces of Example 9 and Reference Example 4 at 23° C. and 160° C., where FIG. 14 shows a relation between their compositions and the coercive forces at 23° C., and FIG. 15 shows a relation between their compositions and the coercive forces at 160° C. As shown in FIG. 14, the composition of 80Pr20Cu led to the highest coercive force at 23° C. Meanwhile as shown in FIG. 15, the Nd—Pr—Cu ternary alloy, especially 40Nd40Pr20Cu, led to a higher coercive force at 160° C.

The following shows a generally known Kronmuller formula as Expression 1, and using this Expression 1, the coercive forces of the rare-earth magnets are organized based on the experimental result:

$$Hc=\alpha Ha-NMs \quad \text{(Expression 1).}$$

In this expression, Hc denotes a coercive force, α denotes a factor to which the degree of separation between main phase (nano-crystalline grains), Ha denotes a crystal magnetic anisotropy (specific to the main phase material), N denotes a factor to which the grain size of the main phase contributes and Ms denotes saturation magnetization (specific to the main phase material).

Figure 16:
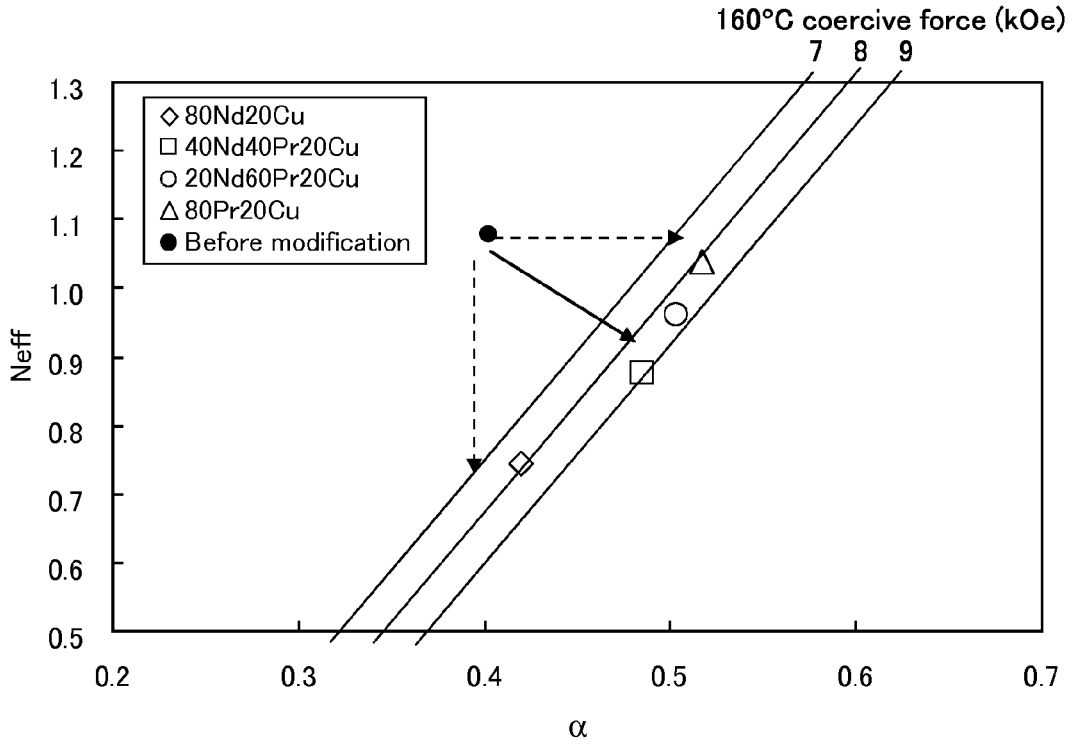
FIG. 16 illustrates the coercive forces of the Reference Example and the Example of FIG. 14 and FIG. 15 based on the Kronmuller formula.

FIG. 16 illustrates the coercive forces as the experimental result of the above-mentioned test pieces based on the above Expression.

This drawing shows a coordinate system including the vertical axis N and the horizontal axis α, on which values of the test pieces are plotted. As crystal grains are made finer and magnetic separation is improved more, values of the rare-earth magnets shift from the upper left area of the coordinates that is a state of a compact to the lower right area of the coordinates that is a state of liquid-phase penetration of the modifier alloy melt. In this drawing, an iso-coercivity line of the coercive forces at 160° C. also is illustrated, and it is further specified that a larger α value and a smaller N value lead to improvement of the heat resistance of rare-earth magnets. Even with the same amount of modifier alloy used, alloys 40Nd40Pr20Cu and 20Nd60Pr20Cu both led to higher coercive forces. Accordingly, it can be found that a ternary alloy containing both of Nd and Pr allows a coercive force at high temperatures to be kept high and so is efficient.

As shown in FIG. 16, in comparison of α values and N values of the magnets before and after modification, the magnet modified with 80Pr20Cu did not change in N value and increased in α value. Conversely, the magnet modified with 80Nd20Cu did not change in α value and decreased in N value. On the other hand, the magnets modified with 40Nd40Pr20Cu and 20Nd60Pr20Cu decreased in N value, while increasing in a. In this way, all of the magnets were improved in coercive force at high temperatures, and their principle for improvement is different among Nd—Cu, Pr—Cu and Nd—Pr—Cu.

(Result 2 for Confirming the Effects)

Figure 17:
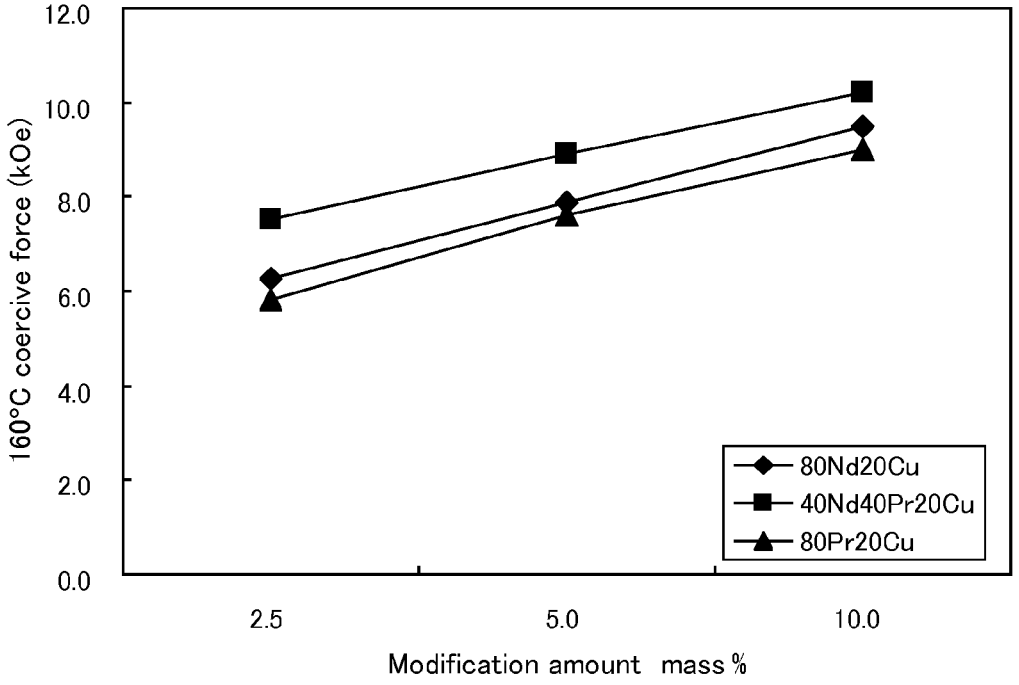
FIG. 17 shows an experimental result to verify the modification amount and the modification effect by modifier alloys, indicating a result of coercive forces at 160° C. for a Reference Example and an Example.
Figure 18:
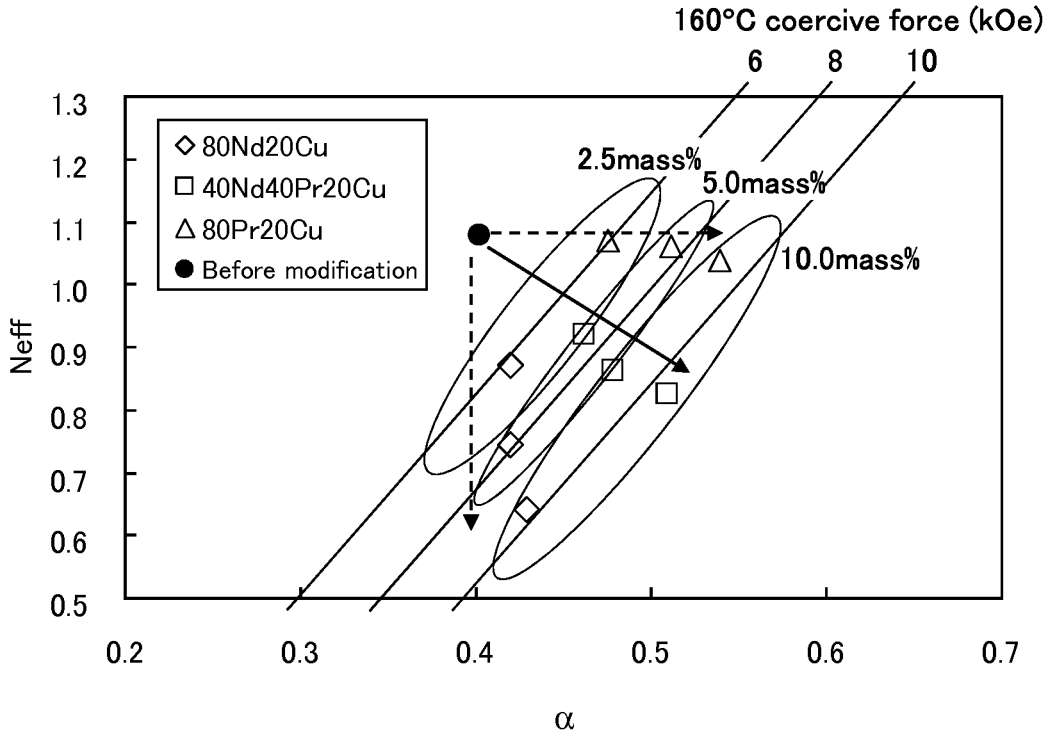
FIG. 18 illustrates the coercive forces of the Reference Example and the Example of FIG. 17 based on the Kronmuller formula.

The following describes coercive forces at 160° C. of Example 10 and Reference Example 5. FIG. 17 shows a relation between modification amounts by the modifier alloys and coercive forces at 160° C., and FIG. 18 shows a relation among the modification amounts by the modifier alloys, α values and N values, which are organized by the Kronmuller formula. The magnet of 40Nd40Pr20Cu led to the highest coercive force at 160° C. in any modification amount.

The reason why the Nd—Pr—Cu ternary alloy led to a high coercive force at 160° C. is because, presumably, the modification processing shifted α larger and $N_{eff}$ smaller (toward lower right direction of the chart). As for binary alloys, even when the modification amount is increased, only one of the coefficients is improved, so that the coercive forces at 160° C. thereof were low. Herein, the reason why α changes with the use of Pr—Cu is because a peripheral portion of the main phase of the magnet and Pr entering by modification cause electron displacement, whereby physical property values relating to Ha changes. On the other hand, in the case of Nd—Cu used, since Nd atoms originally exist in the main phase, no reaction occurs with the main phase (i.e., physical property values relating to Ha does not change). The reason why $N_{eff}$ only changes is because Nd atoms preferentially concentrate at the grain boundary phase, and as a result heavily deformation processing makes the separation effect of magnetically coupled grains prominent.

Although the embodiments of the present invention have been described in detail with reference to the drawings, the specific configuration is not limited to these embodiments, and the design may be modified without departing from the subject matter of the present invention, which falls within the present invention.

What is claimed is:

1. A method for manufacturing a rare-earth magnet, comprising the steps of:

first step of pressing-forming powder as a rare-earth magnet material to form a compact, the powder including a RE-Fe-B main phase and a RE-X alloy grain boundary phase surrounding the main phase, wherein RE is at least one type of Nd and Pr, and X is a metal element; and second step of bringing a modifier alloy into contact with the compact, followed by heat treatment to penetrant-diffuse melt of the modifier alloy into the compact to manufacture the rare-earth magnet, the modifier alloy including a Nd—Pr—Cu alloy or a Nd—Pr—Al alloy as an alloy having a eutectic composition including Nd and Pr or a Nd, Pr-rich hyper-eutectic composition, and the heat treatment in the second step is performed at a temperature in a range of from 480 to 580° C.

* * * * *